US012660904B2

(12) United States Patent
Baranes et al.

(10) Patent No.: US 12,660,904 B2
(45) Date of Patent: Jun. 23, 2026

(54) PACKAGING DEVICE, IN PARTICULAR FOR A COSMETIC PRODUCT, PROVIDED WITH A REMOVABLE BOTTLE

(71) Applicant: BARALAN INTERNATIONAL S.P.A., Trezzano sul Naviglio (IT)

(72) Inventors: Roland Baranes, Milan (IT); Maurizio Ficcadenti, Turin (IT)

(73) Assignee: BARALAN INTERNATIONAL S.P.A., Trezzano sul Naviglio (IT)

( * ) Notice: Subject to any disclaimer, the term of this patent is extended or adjusted under 35 U.S.C. 154(b) by 102 days.

(21) Appl. No.: 18/850,012

(22) PCT Filed: Mar. 24, 2023

(86) PCT No.: PCT/IB2023/052907
§ 371 (c)(1),
(2) Date: Sep. 23, 2024

(87) PCT Pub. No.: WO2023/180998
PCT Pub. Date: Sep. 28, 2023

(65) Prior Publication Data

US 2025/0213021 A1 Jul. 3, 2025

(30) Foreign Application Priority Data

Mar. 24, 2022 (IT) ..... 102022000005831

(51) Int. Cl.
*A45D 34/00* (2006.01)

(52) U.S. Cl.
CPC ..... *A45D 34/00* (2013.01); *A45D 2034/005* (2013.01); *A45D 2034/007* (2013.01); *A45D 2200/056* (2013.01)

(58) Field of Classification Search
CPC ..... A45D 34/00; A45D 2034/005; A45D 2034/007; A45D 2200/056; A45D 2040/0037; B05B 11/0038
See application file for complete search history.

(56) References Cited

U.S. PATENT DOCUMENTS

| | | | | |
|---|---|---|---|---|
| 9,573,151 | B1 | 2/2017 | Miller et al. | |
| 2020/0102138 | A1 | 4/2020 | Eng et al. | |
| 2022/0240641 | A1* | 8/2022 | Ficcadenti | B05B 11/028 |
| 2023/0270233 | A1* | 8/2023 | Ficcadenti | A45D 34/045 |
| 2025/0213021 | A1* | 7/2025 | Baranes | A45D 34/00 |

FOREIGN PATENT DOCUMENTS

| | | | |
|---|---|---|---|
| FR | 2780621 | A1 | 1/2000 |
| WO | 03/030699 | A2 | 4/2003 |
| WO | 2021/125513 | A1 | 6/2021 |

OTHER PUBLICATIONS

International Search Report and Written Opinion for PCT/IB2023/052907(Jul. 14, 2023).

* cited by examiner

*Primary Examiner* — Khaled Annis
(74) *Attorney, Agent, or Firm* — Merchant & Gould P.C.

(57) ABSTRACT

A packaging device includes a case, a bottle to contain a product to be dispensed, and a dispenser assembly situated at the top of the case and configured to dispense the product contained in the bottle. The bottle is housed in a manner such that the bottle is removable from the case, and can be mechanically coupled, in a removable fashion, to either the case or the dispenser assembly.

16 Claims, 10 Drawing Sheets

PACKAGING DEVICE, IN PARTICULAR FOR A COSMETIC PRODUCT, PROVIDED WITH A REMOVABLE BOTTLE

This application is a National Stage Application of International Application No. PCT/IB2023/052907, filed Mar. 24, 2023, which claims benefit of application No. 102022000005831, filed Mar. 24, 2022 in Italy and which applications are incorporated herein by reference. To the extent appropriate, a claim of priority is made to each of the above-disclosed applications.

TECHNICAL FIELD

The present invention relates to a packaging device, in particular for a cosmetic product.

TECHNICAL BACKGROUND

Packaging devices are known, particularly in the field of cosmetic products, which comprise a case, a bottle intended to contain a product to be dispensed, and a dispenser assembly situated at the top of the case and configured to dispense the product contained in the bottle.

Some examples of such devices are provided in US 2020/102138 A1, WO 2021/125513 A1, U.S. Pat. No. 9,573,151 B1, WO 03/030699 A2.

Prior-art document FR 2 780 621 A1 discloses a liquid packaging and dispensing unit having a container fixed in an outer shell by fasteners which are engaged by pressure application and by tool insertion through shell side openings. In particular, the unit comprises an inner container, a dispensing device engaging a container opening and an outer open-bottom rigid or semi-rigid shell for accommodating the internal container. The shell has a top opening for container communication with the exterior and has fasteners for engaging complementary container fasteners to fix the container within the shell when axial pressure is applied onto the shell and/or the container. The shell also has one or more side openings extending towards its fasteners to allow passage of a tool which causes engagement of the shell and container fasteners.

This type of packaging device suffers from a number of drawbacks that should be remedied.

SUMMARY OF THE INVENTION

It is one object of the present invention to provide an improved packaging device which can overcome the drawbacks of the prior art.

In particular, it is desirable to provide a packaging device that, once used, can be easily disassembled, so that its components can be disposed of and possibly recycled.

According to the present invention, these and other objects are achieved through a packaging device.

It is understood that the appended claims are an integral part of the technical teachings provided in the following detailed description of the present invention.

Further features and advantages of the present invention will become apparent in light of the following detailed description, provided herein merely as a non-limiting example and referring, in particular, to the annexed drawings as summarized below.

Figure 1:
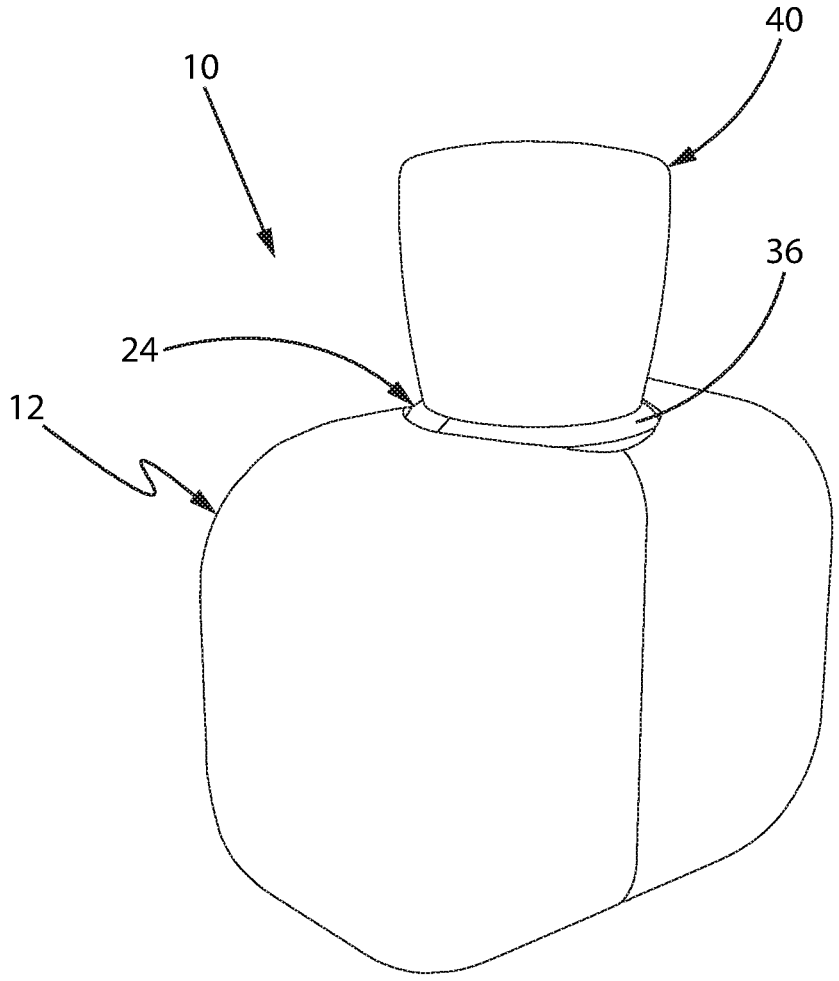
FIG. 1 is a perspective view of a packaging device made in accordance with an illustrative embodiment of the present invention.

For completeness' sake, the following is a list of alphanumerical references and names used herein to identify parts, elements and components illustrated in the above-summarized drawings.

10. Packaging device
12. Case
14. Bottle
16. Container body
18. Receptacle
20. Aperture
22. Neck
24. Dispenser assembly
26. Delivery nozzle
28. Actuator
29. Pump
30. Piston
32. Releasable coupling means
34. Mouth
36. Support annular member
38. Thread
39. Thread
40. Cover member
42. Suction tube
44. Hollow body
46. Bottom cap
48. Annular abutment
49. Connection perimetral portion
50. Outer guide annular wall
52. Inner guide annular wall

DETAILED DESCRIPTION OF THE INVENTION

Figure 2B:
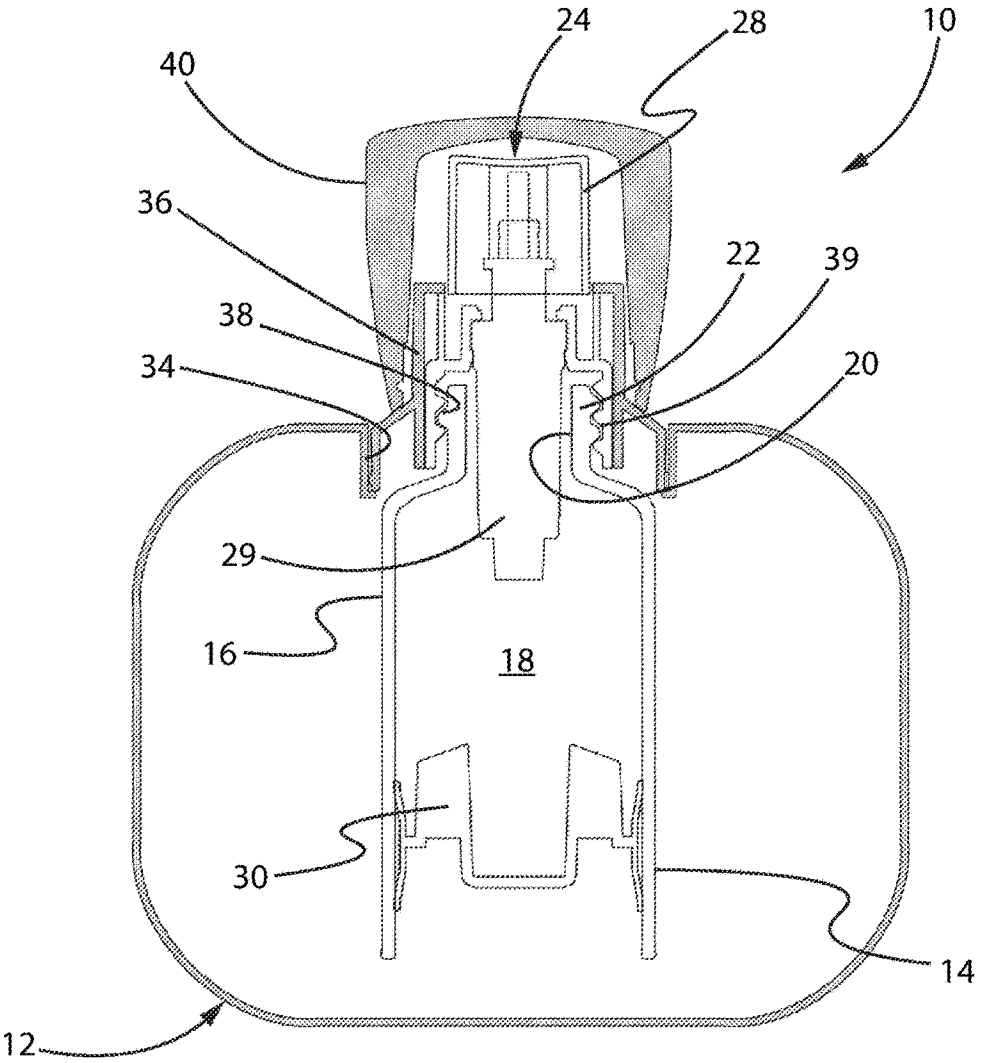
FIGS. 2*a* and 2*b* are longitudinal sectional views, respectively obtained through a lateral plane and a frontal plane, of the packaging device made in accordance with the embodiment shown in FIG. 1.
Figure 2A:
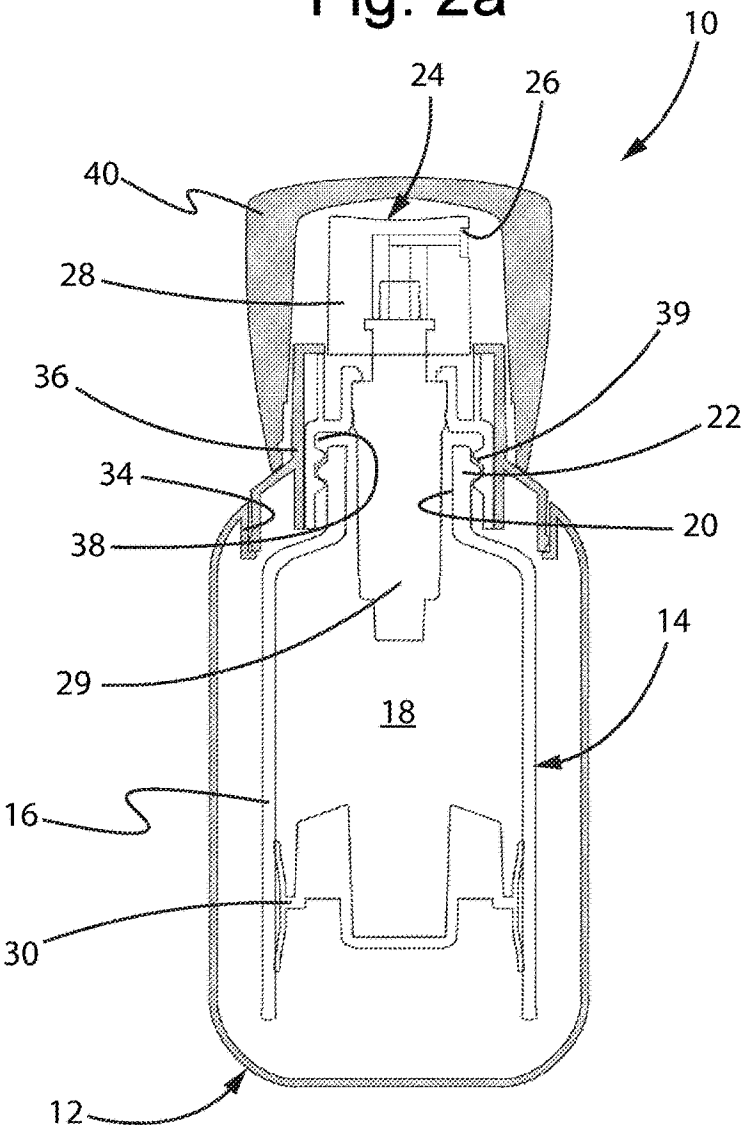

With reference to FIGS. 1, 2*a* and 2*b*, numeral 10 designates as a whole a packaging device for a cosmetic product, made in accordance with an embodiment which is not a subject of the present invention.

As will be apparent to a person skilled in the art, packaging device 10 is particularly suitable for use in the field of cosmetic products, but may also be used in different applications for dispensing products other than cosmetic ones.

Packaging device 10 comprises a case 12, preferably made of plastic, and a bottle 14, preferably made of glass. Bottle 14 is intended to contain a product to be dispensed, advantageously but not necessarily a cosmetic product. Furthermore, bottle 14 is configured to be housed inside case 12.

In particular, bottle 14 comprises a hollow container body 16 internally defining a receptacle 18 intended to contain the cosmetic product. As can be seen in the drawings, hollow container body 16 preferably has a cylindrical shape, in particular with a circular cross-section. Hollow container body 16 has an aperture 20 at its top, through which the cosmetic product contained in receptacle 18 can exit; for example, aperture 20 may be provided in a neck 22 forming a narrower portion at the top of the hollow container body 16.

In addition, packaging device 10 comprises a dispenser assembly 24 situated at the top of case 12 and configured to dispense the product contained in bottle 14. In particular, as will be further described hereinafter, dispenser assembly 24 can be fluidically coupled to bottle 14 in different ways in order to achieve product dispensation.

Furthermore, bottle 14 is housed in a manner such that it can be extracted from case 12 and can be mechanically coupled, in a removable fashion, to either case 12 or dispenser assembly 24. In the embodiment shown in FIGS. 1, 2*a* and 2*b*, bottle 14 can be mechanically coupled, in a removable fashion, to case 12. In particular, bottle 14 is a tank that can be removed from case 12. Preferably, bottle 14 can be repeatably inserted into and extracted from case 12. Thus, bottle 14 can be easily separated from case 12, so that it can be readily disposed of or replaced with a spare bottle. This is also advantageous in view of recycling when case 12 and bottle 14 are made of different materials, e.g. when case 12 is made of plastic and bottle 14 is made of glass.

Dispenser assembly 24 further comprises a delivery nozzle 26 and an actuator 28 configured to be manually operated by a user, e.g. by applying pressure thereon, so as to push out the cosmetic product contained in bottle 14 through delivery nozzle 26 in a per se known manner. In particular, actuator 28 is situated at the top of dispenser assembly 16, and delivery nozzle 26 is formed through it, extending laterally outwards of actuator 28.

In the embodiment illustrated in FIGS. 1, 2*a* and 2*b*, dispenser assembly 24 comprises a mechanical pump 29, per se known, in particular a vacuum-operated pump, while bottle 14 comprises a piston 30 slidably and guidedly mounted inside container body 16 and delimiting receptacle 18 at its bottom, in particular forming the bottom wall of the latter. When bottle 14 is fluidically coupled to dispenser assembly 24, upon pressing actuator 28 pump 29 will cause piston 30 to slide upwards within container body 16. Piston 30 will then push the cosmetic product contained in the bottle towards delivery nozzle 26.

Figure 4C:
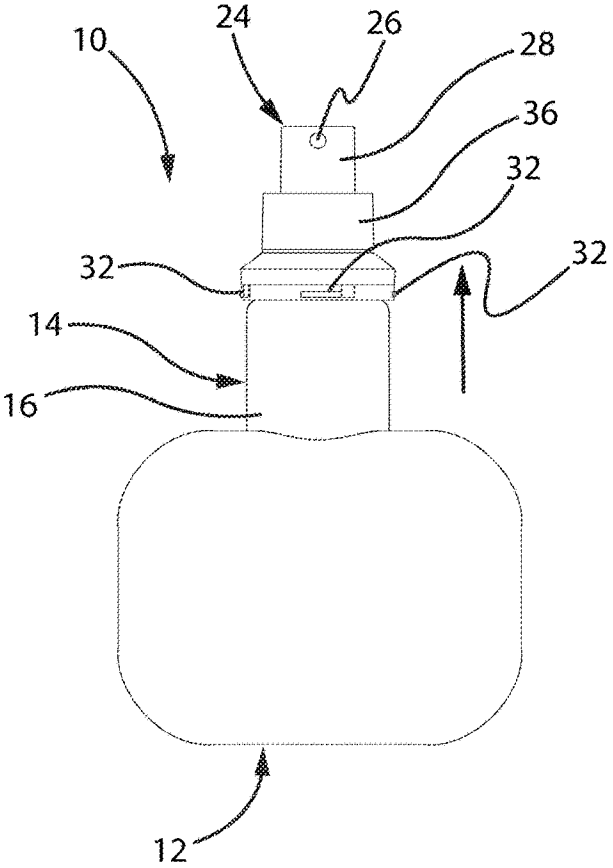
FIGS. 4*a* to 4*c* are front elevation views showing an operating sequence for the extraction of a removable bottle, which is applicable to a packaging device made in accordance with the preceding embodiments.
Figure 5C:
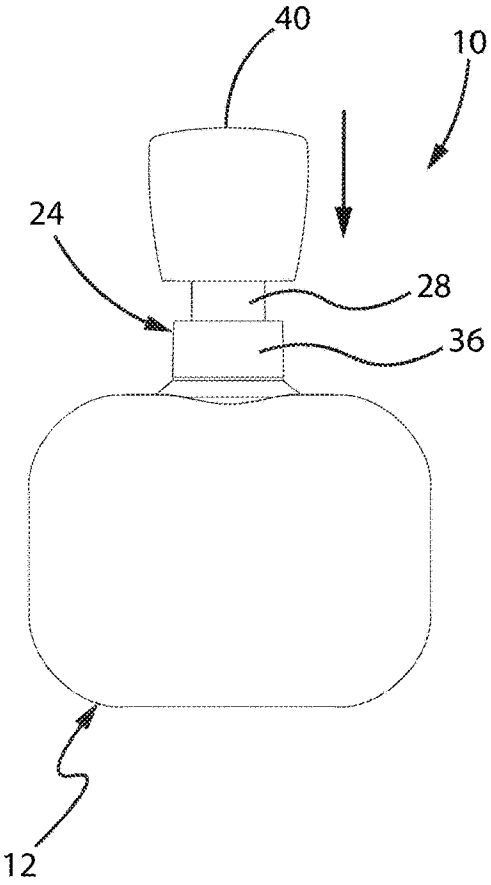
FIGS. 5*a* to 5*c* are front elevation views of an operating sequence for the insertion of a removable bottle, which is applicable to a packaging device made in accordance with the preceding embodiments.
Figure 5B:
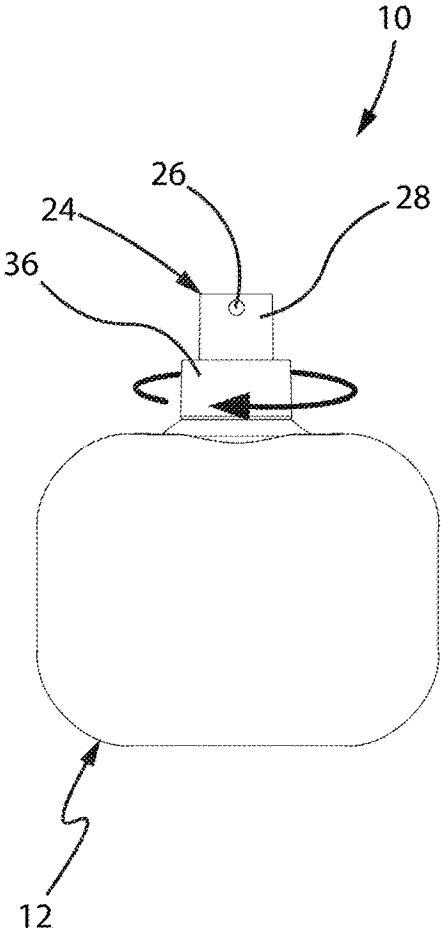
Figure 5A:
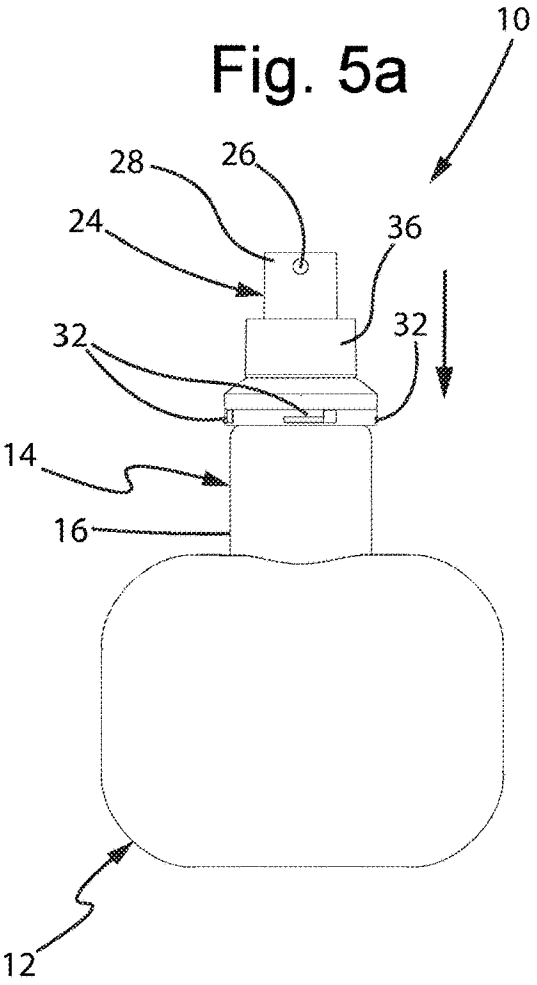

In the embodiment illustrated in FIGS. 1, 2*a* and 2*b*, as aforementioned, dispenser assembly 24 supports bottle 14 and is mechanically coupled, in a removable fashion, to case 12, in particular via releasable coupling means 32 (only visible in FIGS. 4*c* and 5*a*). In other words, bottle 14 and dispenser assembly 24 form a single unit that can be extracted from case 12 when dispenser assembly 24 is disconnected from case 12. Particularly, dispenser assembly 24 can be repeatably coupled to and decoupled from case 12.

In the embodiment shown in FIGS. 1, 2*a* and 2*b*, bottle 14 can be extracted through the top of case 12. In particular, case 12 has a mouth 34 at its top, through which bottle 14 can be inserted or removed. In fact, the width of mouth 34 is greater than the width of bottle 14, which can thus be inserted and extracted through it.

Dispenser assembly 24 preferably also has a support annular member 36 which is configured to support bottle 14 and which is a part of either case 12 or the dispenser assembly 24. Still with reference to the illustrative example shown in FIGS. 1, 2*a* and 2*b*, support annular member 36 is a part of dispenser assembly 24. Moreover, support annular member 36 can be decoupled from case 12 and can be extracted, together with the rest of dispenser assembly 24 and bottle 14, through the top of case 12.

Preferably, support annular member 36 comprises, on its external lateral surface, releasable coupling means 32 that co-operate with an internal annular surface of the mouth 22. More preferably, releasable coupling means 32 establish, together with mouth 22, a bayonet-type coupling.

Preferably, the support annular member 36 can be removably coupled to bottle 14. In particular, support annular member 36 can be repeatably coupled to and decoupled from bottle 14. Advantageously, support annular member 36 can be coupled to bottle 14 via a threaded coupling. Preferably, support annular member 36 also comprises a thread 38, in particular formed on its inner side, which can be coupled to a complementary thread 39 formed on neck 22 of bottle 14, in particular on the outer side thereof.

Furthermore, support annular member 36 supports pump 29 and actuator 20 of dispenser assembly 24, permitting them to be actuated by pressure.

Preferably, packaging device 10 comprises also a cover member 40 which can be removably coupled to either case 12 or dispenser assembly 24, so as to enclose dispenser assembly 24. In particular, cover member 40 is configured to enclose and cover actuator 28 and delivery nozzle 26, thus protecting them from the outside environment. In the embodiment illustrated in FIGS. 1, 2*a* and 2*b*, cover member 40 can be removably coupled to dispenser assembly 24, e.g. to support annular member 36. In particular, cover member 40 can be repeatably coupled to and decoupled from support annular member 36 of dispenser assembly 24.

Figure 3B:
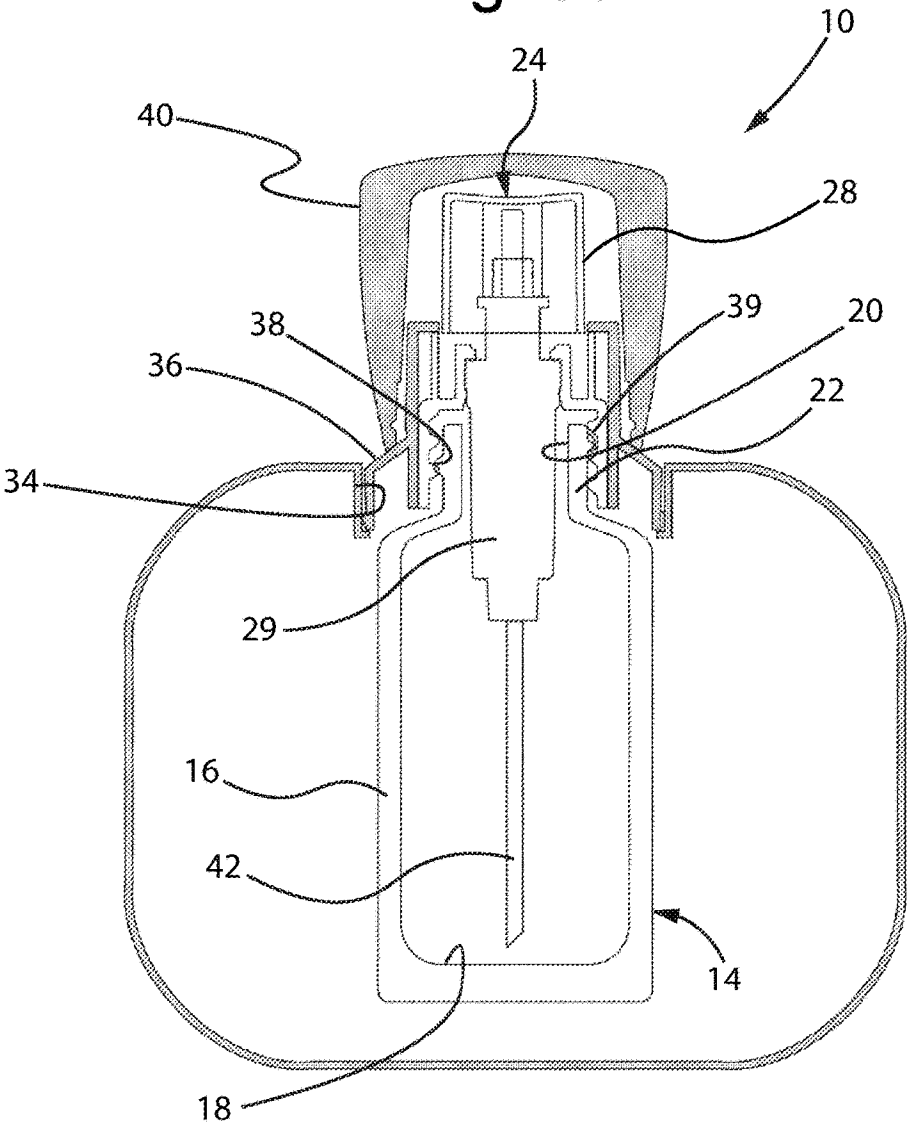
FIGS. 3*a* and 3*b* are longitudinal sectional views, respectively obtained through a lateral plane and a frontal plane, of a packaging device made in accordance with an embodiment which is alternative to the one shown in the preceding figures.
Figure 3A:
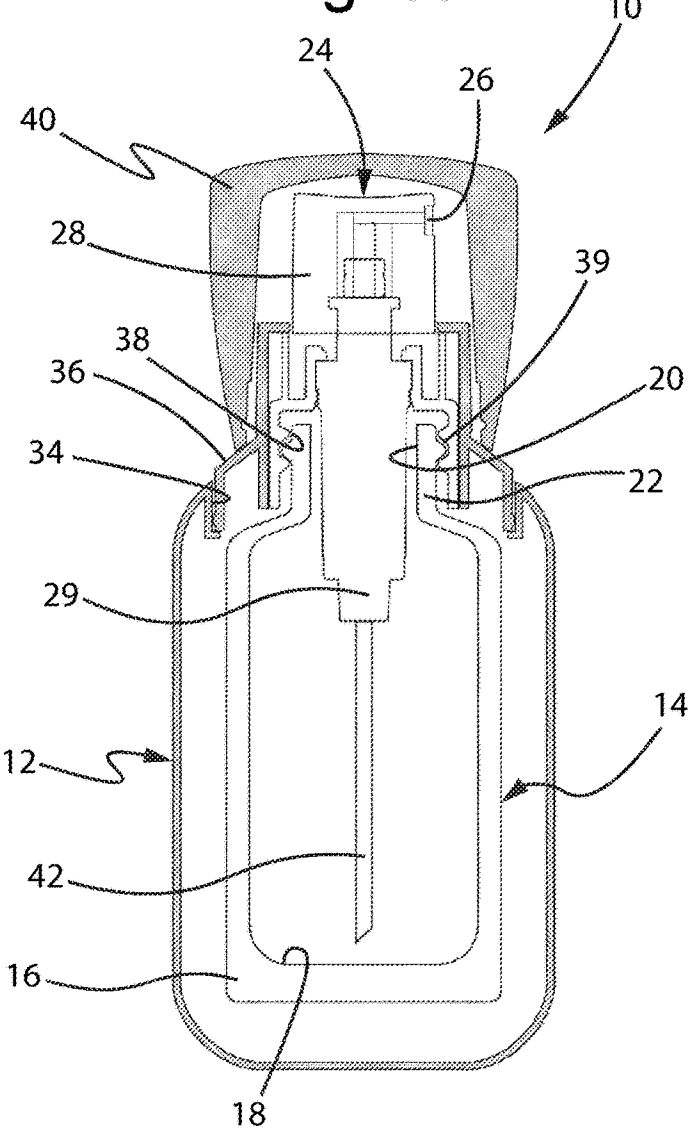

With reference to FIGS. 3*a* and 3*b*, the following will illustrate an embodiment which is alternative to the one described above.

Those parts and elements which are similar to—or which perform the same function as—those of the above-described embodiment have been assigned the same reference numerals. For simplicity, the description of such parts and elements will not be repeated below, and reference should be made to the above description of the preceding embodiment.

Unlike the embodiment illustrated in FIGS. 1, 2*a* and 2*b*, bottle 14 lacks piston 30, while dispenser assembly 24 is provided with a suction tube 42 configured to take in the cosmetic product contained in bottle 14. In particular, suction tube 42 is operatively connected to pump 29 and extends within container body 16, when dispenser assembly 24 is fluidically coupled to bottle 14. Upon actuation of actuator 28, pump 29 will take in the cosmetic product contained in receptacle 18 through suction tube 42 and will deliver it through delivery aperture 20.

Figure 4B:
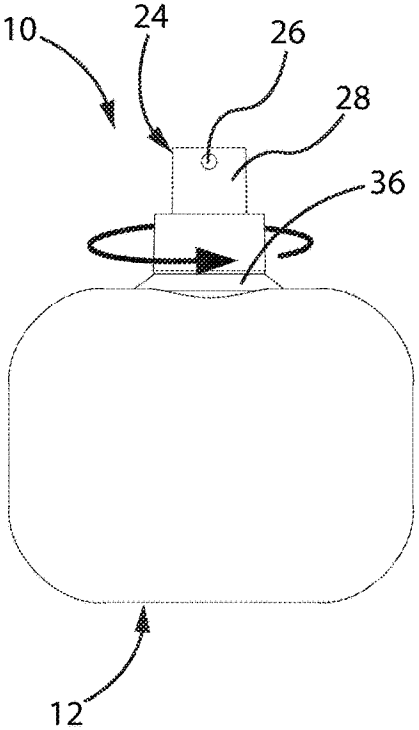
Figure 4A:
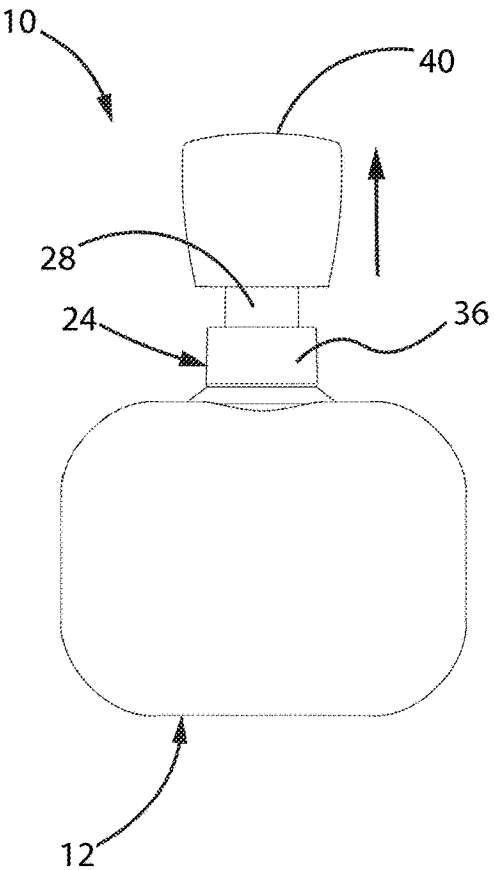

With reference to the embodiments illustrated in FIGS. 1, 2*a*, 2*b*, 3*a* and 3*b*, the following will describe, through FIGS. 4*a* to 4*c*, one illustrative mode of extraction of bottle 14 from case 12.

In FIG. 4*a*, cover member 40 is removed to expose dispensing assembly 24.

In FIG. 4*b*, dispenser assembly 24 is decoupled from case 12, in particular by deactivating the releasable coupling means 32. For example, support annular member 36 is turned to release the bayonet-type coupling means.

In FIG. 4*c*, dispenser assembly 24 is raised from mouth 34 and extracted from case 12. The single unit made up of dispenser assembly 24 and bottle 14—which are made integral by support annular member 36—is then removed from case 12.

During a next step (not shown) it is also possible to decouple bottle 14 from dispenser assembly 24, e.g. by separating neck 22 from support annular member 36. In particular, by mutually turning container body 16 and support annular member 36 in a decoupling direction, complementary threads 38, 39 of support annular member 36 and of neck 22 can be mutually disengaged.

Still with reference to the embodiments illustrated in FIGS. 1, 2*a*, 2*b*, 3*a* and 3*b*, the following will describe, through FIGS. 5*a* to 5*c*, one illustrative mode of insertion of bottle 14 into case 12.

During a previous step (not shown) it is also possible to couple bottle 14 to dispenser assembly 24, e.g. by joining neck 22 to support annular member 36. In particular, by mutually turning container body 16 and support annular member 36 in a coupling direction, complementary threads 38, 39 of support annular member 36 and of neck 22 can be mutually engaged.

In FIG. 5*a*, the single unit made up of dispenser assembly 24 and bottle 14 is inserted into case 12. Bottle 14 is introduced into case 12 through mouth 34.

In FIG. 5*b*, dispenser assembly 24 is coupled to case 12, in particular by activating releasable coupling means 32. For example, support annular member 36 is turned to lock the bayonet-type coupling means.

In FIG. 5*c*, cover member 40 is applied to enclose the dispensing assembly 24.

Figure 6:
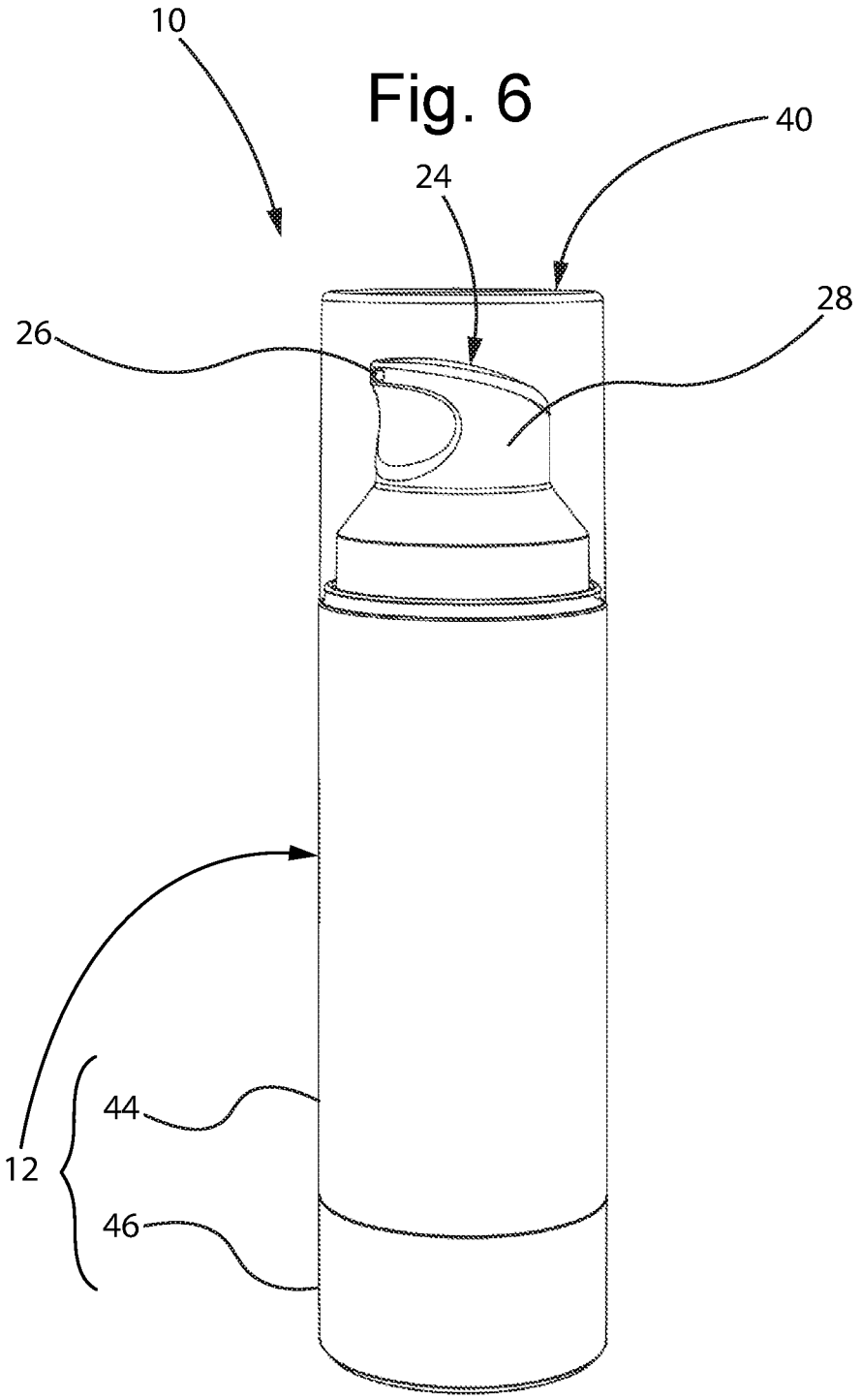
FIG. 6 is a perspective view of a packaging device made in accordance with an illustrative embodiment of the present invention.
Figure 7B:
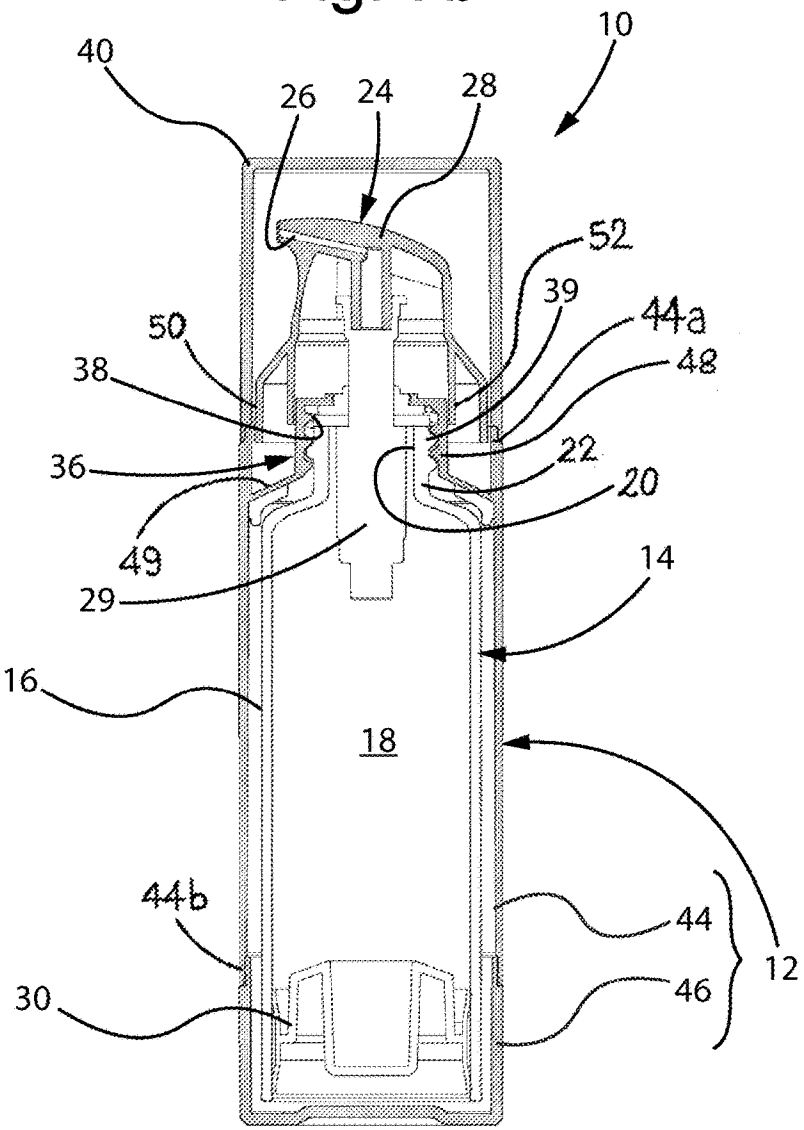
FIGS. 7*a* and 7*b* are longitudinal sectional views, respectively obtained through a lateral plane and a frontal plane, of the packaging device made in accordance with the embodiment shown in FIG. 6.
Figure 7A:
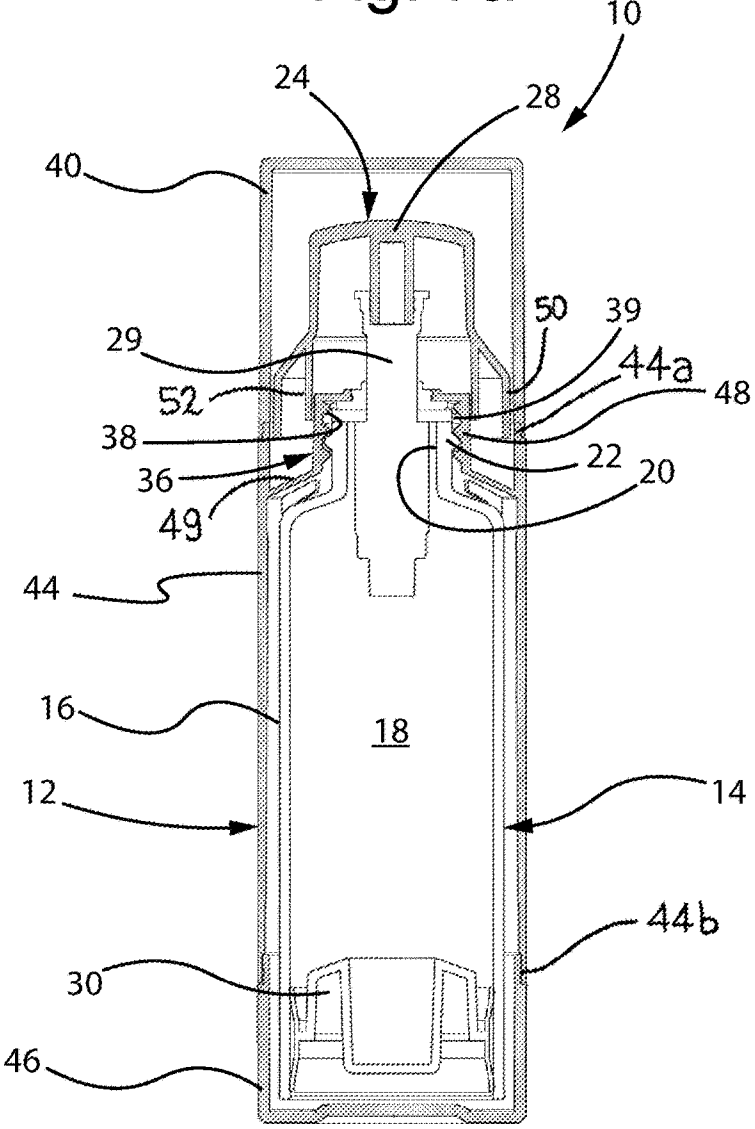

With reference to FIGS. 6, 7*a*, 7*b*, the following will describe an illustrative of embodiment of the present invention.

Those parts and elements which are similar to—or which perform the same function as—those of the embodiment illustrated in FIGS. 1, 2*a* and 2*b* have been assigned the same reference numerals. For simplicity, the description of such parts and elements will not be repeated below, and reference should be made to the description of the embodiment illustrated in FIGS. 1, 2*a* and 2*b*.

Unlike the embodiment illustrated in FIGS. 1, 2*a* and 2*b*, support annular member 36 is a part of case 12. In addition, case 12 comprises a hollow body 44 and a bottom cap 46 removably mounted to hollow body 44. As is visible in FIGS. 6, 7*a*, 7*b*, in hollow body 44 the top end is designated as 44*a* and the bottom end is designated as 44*b*.

In particular, hollow body 44 and bottom cap 46 are assembled in such a way that they can be repeatably coupled to and decoupled from each other. The coupling between hollow body 44 and bottom cap 46 preferably occurs via releasable coupling means, e.g. snap-type ones.

Hollow body 44 carries the support annular member 36, which is situated at the top of said hollow body 44. Preferably, support annular member 36 is made as one piece with the top of hollow body 44. In particular, support annular member 36 cannot be removed or extracted from hollow body 44 of case 12.

With reference to FIGS. 6, 7*a* and 7*b*, bottle 14 can be decoupled from support annular member 36 and can be extracted through the bottom of hollow body 44, once bottom cap 46 has been removed from hollow body 44. Preferably, bottle 14 protrudes past the bottom of hollow body 44 when bottle 14 is coupled to support annular member 36. In particular, bottle 14 extends below hollow body 44. In this manner, when bottom cap 46 is removed, bottle 14 will be accessible to a user, who will then be able to decouple it from case 12, in particular from support annular member 36. Vice versa, when bottom cap 46 is coupled to hollow body 44, the bottom of bottle 14 will be enclosed in and protected by case 12.

In the embodiment illustrated in FIGS. 6, 7*a* and 7*b*, hollow body 44 has a substantially tubular shape and/or bottom cap 46 has a substantially cup-like shape. In particular, hollow body 44 has a cylindrical shape, more specifically with a circular cross-section. Advantageously, but not necessarily, case 12 will have, as a whole, cylindrical shape when hollow body 44 is coupled to bottom cap 46, in particular showing a continuous connection between the substantially tubular shape of hollow body 44 and the cup-like shape of bottom cap 46.

In the embodiment illustrated in FIGS. 6, 7*a* and 7*b*, support annular member 36 forms, internally to hollow body 44, an annular abutment 48 against which bottle 14 is configured to abut and to which neck 22 of bottle 14 can be coupled. In particular, annular abutment 48 has a radially inward thread 38 with which a complementary thread 39 formed radially outwards of neck 22 can be coupled.

In the embodiment illustrated in FIGS. 6, 7*a* and 7*b*, annular abutment 48 is advantageously cylindrical in shape, in particular with a circular cross-section. Preferably, annular abutment 48 is situated in a transversally (more specifically, radially) internal position within hollow body 44, being surrounded by the latter.

In the embodiment illustrated in FIGS. 6, 7*a* and 7*b*, support annular member 36 further comprises a connection perimetral portion 49 that widens laterally (more specifically, radially) outwards of annular abutment 48 and joins hollow body 44. Preferably, perimetral portion 49 widens from the bottom end (not numbered) of the annular abutment 48 on one side and/or, on the other side, joins the inner surface of hollow body 44, underneath top end 44*a*. For example, connection perimetral portion 49 has a shape that tapers off towards annular abutment 48, having in particular a substantially frustoconical shape.

Unlike the embodiment illustrated in FIGS. 1, 2*a* and 2*b*, cover member 40 can be removably coupled to case 12, e.g. by snap-type coupling. In particular, cover member 40 is mounted in a manner such that it can be repeatably coupled to and decoupled from case 12. In particular, cover member 40 can be coupled to end 44*a* of hollow body 44, so that case 12 and cover member 40 create, as a whole, a cylindrical shape when coupled together.

In the embodiment illustrated in FIGS. 6, 7*a* and 7*b*, actuator 28 is slidably mounted on and guided by case 12 and/or support annular member 36. Preferably, actuator 28 is slidably mounted on and guided by both case 12 and support annular member 36.

In particular, as far as its sliding action relative to case 12 is concerned, actuator 28 is slidably mounted on hollow body 44. More particularly, actuator 28 is slidably mounted on the laterally internal surface of hollow body 44. Even more particularly, actuator 28 has, at its bottom, an outer guide annular wall 50 (having in this example a cylindrical shape with a circular cross-section) slidably mounted on the laterally internal surface of hollow body 44, in the vicinity of its top end 44*a*.

In particular, as far as its sliding action relative to support annular member 36 is concerned, actuator 28 is slidably mounted on annular abutment 48. More particularly, actuator 28 is slidably mounted on the laterally external surface of annular abutment 38. Even more particularly, actuator 28 has, at its bottom, an inner guide annular wall 52 (having in this example a cylindrical shape with a circular cross-section) slidably mounted on the laterally external surface of annular abutment 44.

Figure 8B:
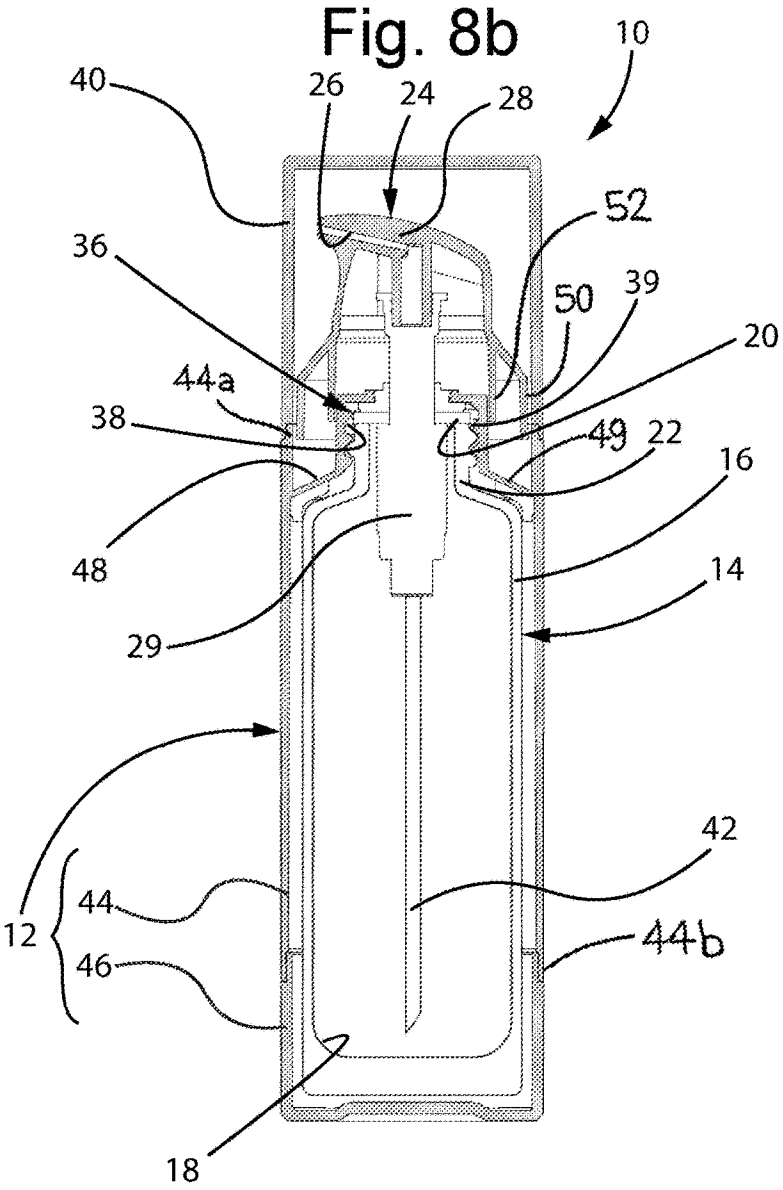
FIGS. 8*a* and 8*b* are longitudinal sectional views, respectively obtained through a lateral plane and a frontal plane, of a packaging device made in accordance with an embodiment which is alternative to the one shown in FIGS. 6, 7*a* and 7*b*.
Figure 8A:
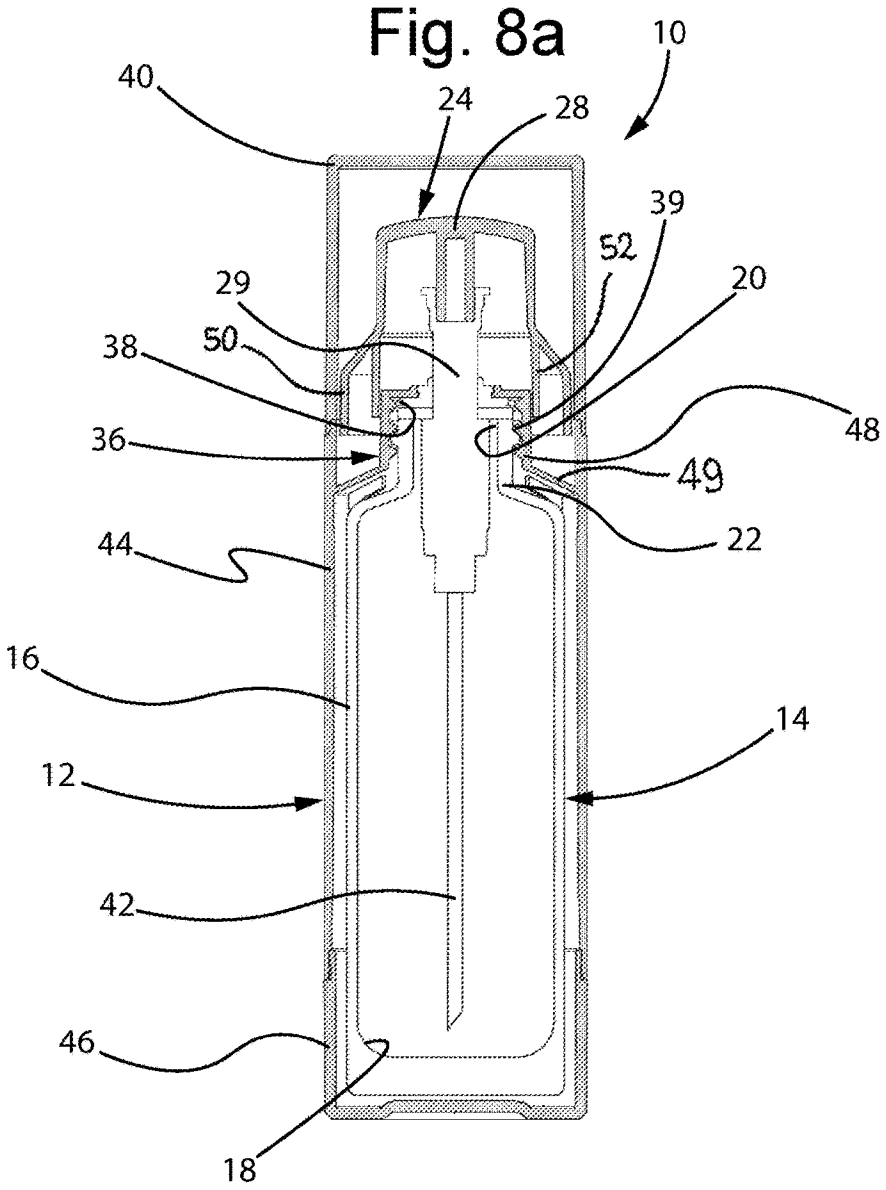

Preferably, outer guide annular wall 50 is situated in a radially external position relative to the further inner guide annular wall 52, in particular such walls being mutually concentric. With reference to FIGS. 8*a*, 8*b*, the following will illustrate an embodiment which is alternative to the embodiments previously described herein.

Those parts and elements which are similar to—or which perform the same function as—those of the embodiment illustrated in FIGS. 6, 7*a* and 7*b* have been assigned the same reference numerals. For simplicity, the description of such parts and elements will not be repeated below, and reference should be made to the description of the embodiment illustrated in FIGS. 6, 7*a* and 7*b*.

Unlike the embodiment illustrated in FIGS. 6, 7*a* and 7*b*, bottle 14 lacks piston 30, while dispenser assembly 24 is provided with a suction tube 42 configured to take in the cosmetic product contained in bottle 14. In particular, suction tube 42 is operatively connected to pump 29 and extends within container body 16, when dispenser assembly 24 is fluidically coupled to bottle 14. Upon actuation of actuator 28, pump 29 will take in the cosmetic product contained in receptacle 18 through suction tube 42 and will deliver it through delivery aperture 20.

Figure 9C:
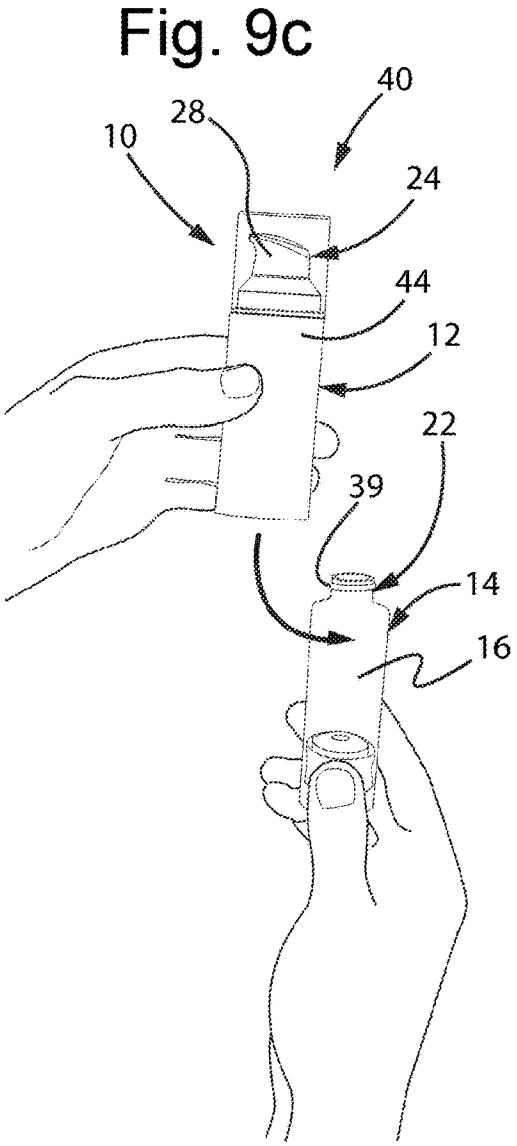
FIGS. 9*a* to 9*c* are front elevation views of an operating sequence for the extraction of a removable bottle, which is applicable to a packaging device made in accordance with the embodiments illustrated in FIGS. 6, 7*a*, 7*b*, 8*a* and 8*b*.
Figure 9B:
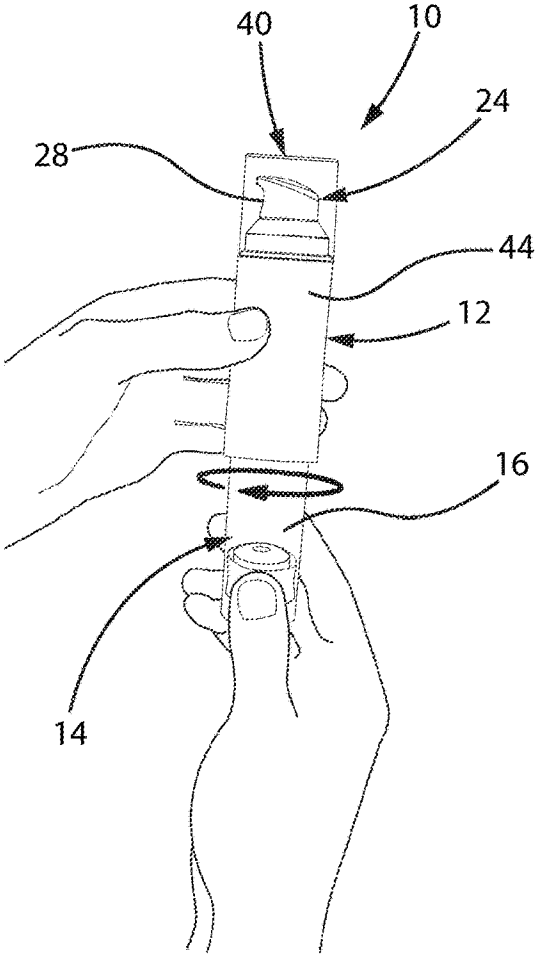
Figure 9A:
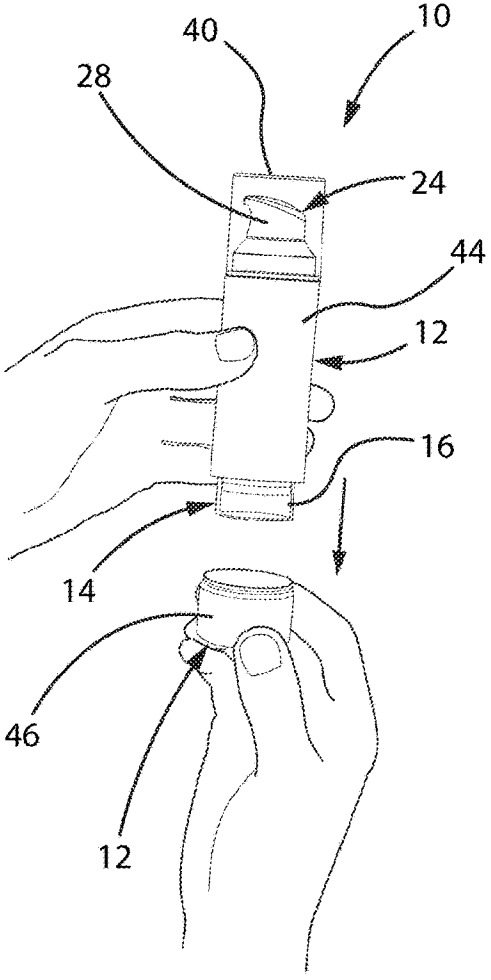

With reference to the embodiments illustrated in FIGS. 6, 7*a*, 7*b*, 8*a* and 8*b*, the following will describe, through FIGS. 9*a* to 9*c*, one illustrative mode of extraction of bottle 14 from case 12.

In FIG. 9*a*, bottom cap 46 is removed from hollow body 44, thus making bottle 14 accessible, which protrudes axially from said hollow body 44.

In FIG. 9*b*, bottle 14 is decoupled from case 12, in particular by disengaging neck 22 from support annular member 36. In particular, container body 16 is rotated relative to hollow body 44 in a decoupling direction, so that complementary threads 38, 39 on support annular member 36 and on neck 22 can be disengaged from each other.

In FIG. 9*c*, bottle 14, which has been unconstrained from case 12, is extracted from hollow body 44.

Figure 10C:
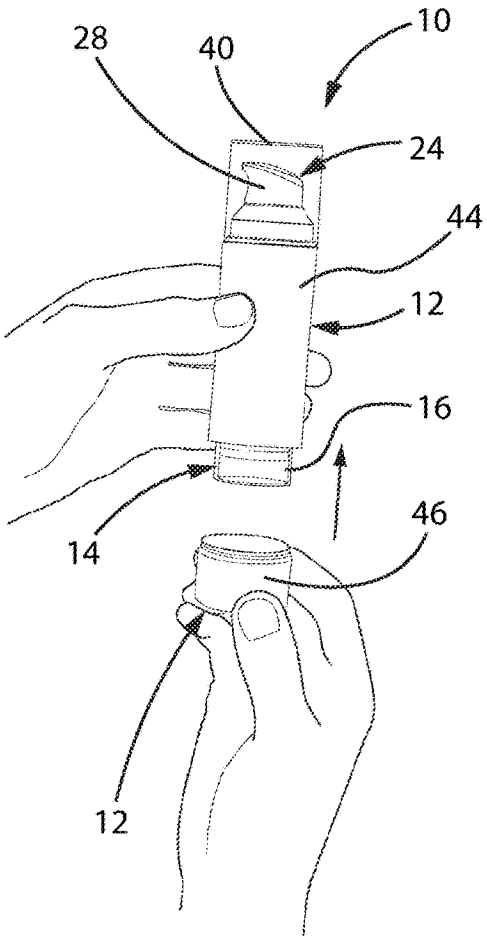
FIGS. 10*a* to 10*c* are front elevation views of an operating sequence for the insertion of a removable bottle, which is applicable to a packaging device made in accordance with the embodiments illustrated in FIGS. 6, 7*a*, 7*b*, 8*a* and 8*b*.
Figure 10B:
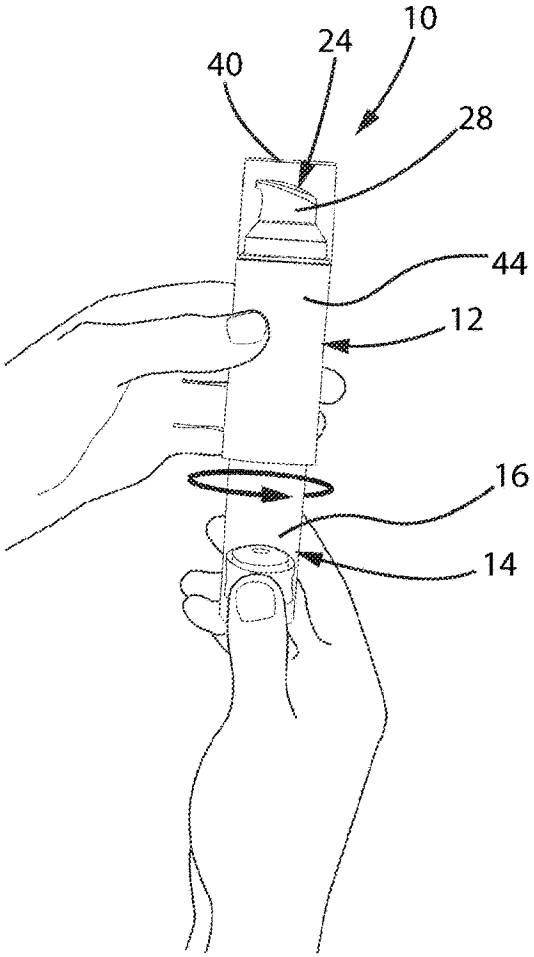
Figure 10A:
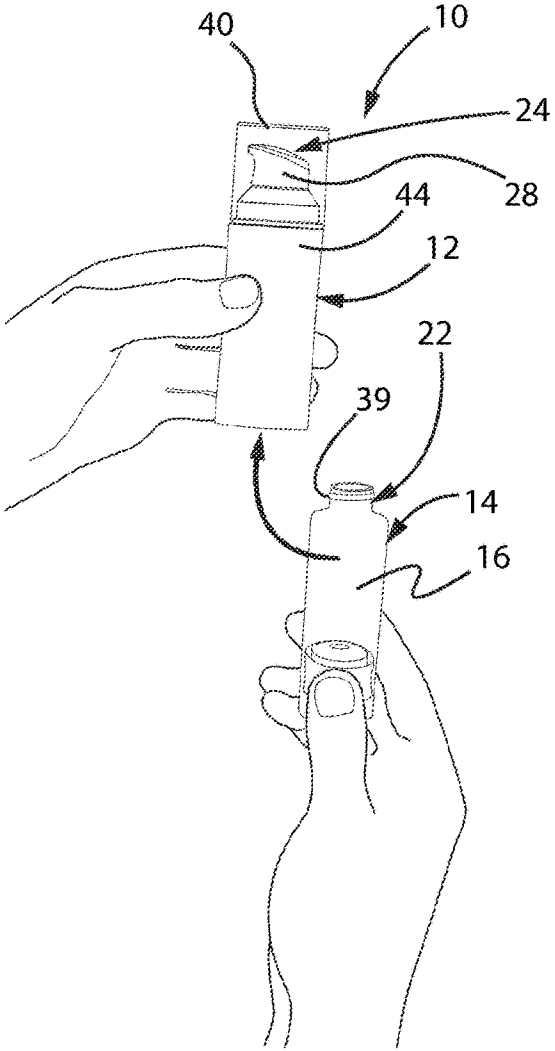

Still with reference to the embodiments illustrated in FIGS. 6, 7*a*, 7*b*, 8*a* and 8*b*, the following will describe, through FIGS. 10*a* to 10*c*, one illustrative mode of insertion of bottle 14 into case 12.

In FIG. 10*a*, bottle 14 is inserted d into case 12 through hollow body 44.

In FIG. 10*b*, bottle 14 is coupled to case 12, in particular by joining neck 22 to support annular member 36. In particular, container body 16 is rotated relative to hollow body 44 in a coupling direction, so that complementary threads 38, 39 on support annular member 36 and on neck 22 can be engaged with each other.

In FIG. 10*c*, bottom cap 46 is applied to hollow body 44, thereby enclosing bottle 14 within case 12.

In the embodiment illustrated in FIGS. 6, 7*a* and 7*b*, and, respectively, in the one shown in FIGS. 8*a* and 8*b*, the assembly made up of hollow body 44 and annular member 36—which are preferably made as one piece—performs simultaneously the following functions: housing and coupling bottle 14, covering and guiding the travel of actuator 28, and coupling cover member 40.

The technical characteristics that differentiate the various embodiments and variants thereof described and illustrated herein are freely interchangeable, whenever compatible.

Of course, without prejudice to the principle of the invention, the forms of embodiment and the implementation details may be extensively varied from those described and illustrated herein by way of non-limiting example, without however departing from the scope of the invention as set out in the appended claims.

The invention claimed is:

1. A packaging device for a cosmetic product, comprising:

a case comprising a hollow body, a support annular member, and a bottom cap mounted to said hollow body;

a bottle to contain a product to be dispensed, wherein said support annular member is configured to support said bottle; and a dispenser assembly situated at a top of the case and configured to dispense said product contained in the bottle;

wherein said hollow body and the bottom cap are assembled so that said hollow body and said bottom cap are repeatably couplable to and decouplable from each other;

wherein said support annular member is removably coupled to the bottle via a threaded coupling; and wherein said bottle, which is decouplable from said support annular member, is housed so that the bottle is removable through the bottom of the hollow body after removing the bottom cap from the hollow body.

2. The device according to claim 1, wherein the support annular member is made as one piece with the top of the hollow body.

3. The device according to claim 1 or 2, wherein said bottle is made of glass.

4. The device according to claim 1, wherein said bottle comprises a hollow container body having a cylindrical shape with a circular cross-section, and internally defining a receptacle to contain the cosmetic product.

5. The device according to claim 1, wherein the support annular member forms, within the hollow body, an annular abutment against which the bottle is configured to abut, and to which a neck of the bottle is couplable via said threaded coupling.

6. The device according to claim 5, wherein the annular abutment has a thread facing radially inwards, to which a complementary thread, facing radially outwards of the neck is couplable.

7. The device according to claim 1, wherein said dispenser assembly comprises an actuator slidably mounted on and guided by at least one of said case and said support annular member.

8. The device according to claim 1, wherein said actuator is slidably mounted on and guided by both the case and the support annular member.

9. The device according to claim 7, wherein the actuator is slidably mounted on the hollow body.

10. The device according to claim 7, wherein the support annular member forms, within the hollow body, an annular abutment against which the bottle is configured to abut, and to which a neck of the bottle is couplable via said threaded coupling, wherein the actuator is slidably mounted on the annular abutment.

11. The device according to claim 1, wherein said bottle protrudes past the bottom of said hollow body, when said bottle is coupled to said support annular member.

12. The device according to claim 1, wherein said hollow body has a substantially tubular shape.

13. The device according to claim 1, wherein said bottom cap has a substantially cup-like shape.

14. The device according to claim 1, wherein said case has, as a whole, a cylindrical shape when the hollow body is coupled to the bottom cap.

15. The device according to claim 1, wherein said hollow body and said bottom cap are couplable together via a releasable coupling means comprising a snap-type coupling means.

16. The device according to claim 1, comprising a cover member removably couplable to said case to enclose said dispenser assembly.

* * * * *